US009526977B2

(12) United States Patent
Edney

(10) Patent No.: US 9,526,977 B2
(45) Date of Patent: Dec. 27, 2016

(54) POWERED SKATE WITH AUTOMATIC MOTOR CONTROL

(71) Applicant: Daniel B. Edney, Irvine, CA (US)

(72) Inventor: Daniel B. Edney, Irvine, CA (US)

( * ) Notice: Subject to any disclaimer, the term of this patent is extended or adjusted under 35 U.S.C. 154(b) by 176 days.

(21) Appl. No.: 13/852,953

(22) Filed: Mar. 28, 2013

(65) Prior Publication Data

US 2013/0282216 A1 Oct. 24, 2013

Related U.S. Application Data

(60) Provisional application No. 61/617,635, filed on Mar. 29, 2012.

(51) Int. Cl.

| | |
|---|---|
| ***A63C 17/12*** | (2006.01) |
| ***A63C 17/00*** | (2006.01) |
| ***A63C 17/04*** | (2006.01) |
| ***A63C 17/14*** | (2006.01) |
| ***A63C 17/22*** | (2006.01) |

(52) U.S. Cl.

CPC ..... *A63C 17/12* (2013.01); *A63C 17/006* (2013.01); *A63C 17/0093* (2013.01); *A63C 17/04* (2013.01); *A63C 17/14* (2013.01); *A63C 17/22* (2013.01); *A63C 2203/12* (2013.01); *A63C 2203/18* (2013.01); *A63C 2203/22* (2013.01); *A63C 2203/24* (2013.01)

(58) Field of Classification Search

CPC ..... B60W 10/08; Y10S 903/93; A63C 17/12; A63C 17/006; A63C 17/0093; A63C 17/04; A63C 17/14; A63C 17/22; A63C 2203/12; A63C 2203/18; A63C 2203/22; A63C 2203/24

USPC ..... 701/22

See application file for complete search history.

(56) References Cited

U.S. PATENT DOCUMENTS

| | | | |
|---|---|---|---|
| 3,399,742 | A | 9/1968 | Malick |
| 3,876,032 | A | 4/1975 | Ferino |
| 3,904,215 | A | 9/1975 | Bardy |
| 4,109,741 | A | 8/1978 | Gabriel |
| 4,151,892 | A | 5/1979 | Francken |
| 4,508,187 | A | 4/1985 | Wenzel |
| 4,546,841 | A | 10/1985 | Sipiano |
| 4,998,596 | A | 3/1991 | Miksitz |
| 5,048,632 | A | 9/1991 | Battel |

(Continued)

FOREIGN PATENT DOCUMENTS

| | | | |
|---|---|---|---|
| CN | 101905079 | A | 12/2010 |
| JP | 2010227491 | A | 10/2010 |
| RU | 99438 | U1 | 11/2010 |

*Primary Examiner* — Behrang Badii
*Assistant Examiner* — Daniel L Greene
(74) *Attorney, Agent, or Firm* — Gabriel Fitch; Loza & Loza, LLP

(57) ABSTRACT

Systems including powered skates with automatic motor control are provided. One such system includes a pair of powered skates, each including a foot platform configured to receive a foot of a rider, a plurality of wheels coupled to the foot platform, a motor coupled to at least one of the plurality of wheels, the motor configured to rotate the at least one wheel, and a load sensor coupled to the foot platform and configured to sense an applied force, and a controller coupled to each of the motors and to each of the load sensors, the controller configured to control each of the motors, using a single algorithm, based on signals received from each of the load sensors.

21 Claims, 8 Drawing Sheets

(56) References Cited

U.S. PATENT DOCUMENTS

| | | | | |
|---|---|---|---|---|
| 5,236,058 | A | 8/1993 | Yamet et al. | |
| 5,413,380 | A | 5/1995 | Fernandez | |
| 5,487,441 | A | 1/1996 | Endo et al. | |
| 5,492,345 | A | 2/1996 | Kruczek | |
| 5,536,026 | A | 7/1996 | Pozzobon et al. | |
| 5,582,529 | A * | 12/1996 | Montgomery | 441/74 |
| 5,701,965 | A | 12/1997 | Kamen et al. | |
| 5,797,466 | A | 8/1998 | Gendle | |
| 5,829,543 | A | 11/1998 | Diaz | |
| 6,050,357 | A | 4/2000 | Staelin et al. | |
| 6,059,062 | A | 5/2000 | Staelin et al. | |
| 6,095,267 | A | 8/2000 | Goodman | |
| 6,398,229 | B1 * | 6/2002 | Saylor | A63C 17/04 280/11.19 |
| 6,428,050 | B1 | 8/2002 | Brandley et al. | |
| 6,539,336 | B1 * | 3/2003 | Vock et al. | 702/182 |
| 6,543,564 | B1 | 4/2003 | Kamen et al. | |
| 6,604,593 | B1 | 8/2003 | Mullet | |
| 6,705,630 | B1 | 3/2004 | Karpman | |
| 7,090,040 | B2 | 8/2006 | Kamen et al. | |
| 7,138,774 | B2 | 11/2006 | Negoro et al. | |
| 7,204,330 | B1 | 4/2007 | Lauren | |
| 7,275,607 | B2 | 10/2007 | Kamen et al. | |
| 7,293,622 | B1 | 11/2007 | Spital | |
| 7,383,908 | B2 | 6/2008 | Tuli | |
| 7,748,490 | B2 | 7/2010 | Hornick et al. | |
| 2001/0032743 | A1 | 10/2001 | Kamen et al. | |
| 2003/0141124 | A1 | 7/2003 | Mullet | |
| 2004/0036248 | A1 | 2/2004 | Karpman | |
| 2006/0170174 | A1 | 8/2006 | Hiramatsu | |
| 2006/0213711 | A1 | 9/2006 | Hara | |
| 2006/0260862 | A1 | 11/2006 | Nishikawa | |
| 2007/0158117 | A1 | 7/2007 | Alexander | |
| 2008/0295595 | A1 | 12/2008 | Tacklind et al. | |
| 2009/0135133 | A1 * | 5/2009 | Kunzler | A63F 13/06 345/156 |
| 2009/0288900 | A1 | 11/2009 | Takenaka et al. | |
| 2010/0090423 | A1 | 4/2010 | Farrelly | |
| 2010/0114420 | A1 | 5/2010 | Doi | |
| 2010/0126787 | A1 | 5/2010 | Kawada | |

* cited by examiner

Fig.9a
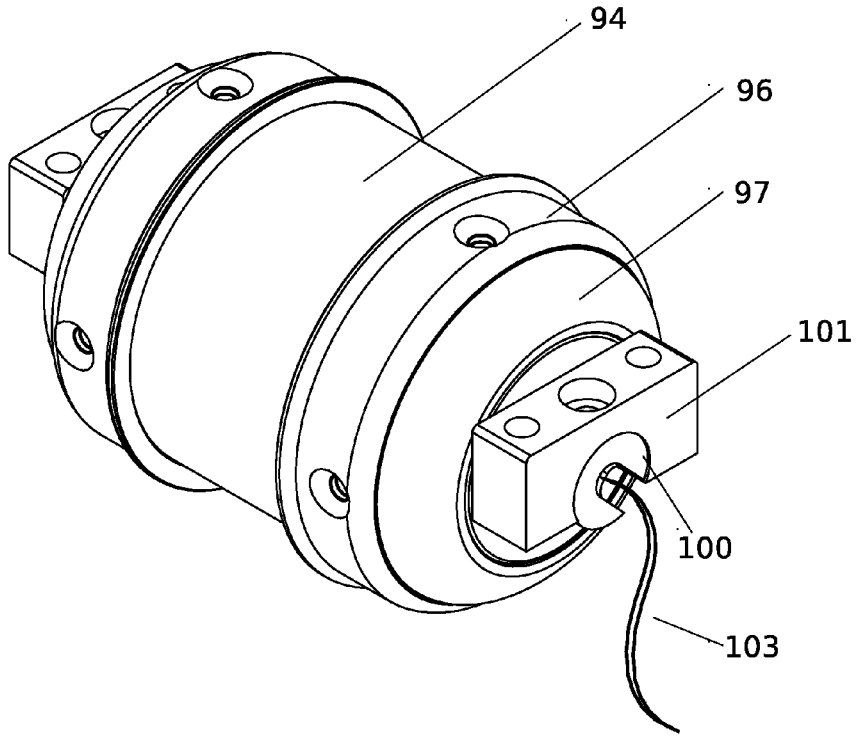
Fig.9b
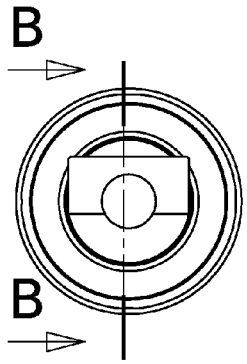
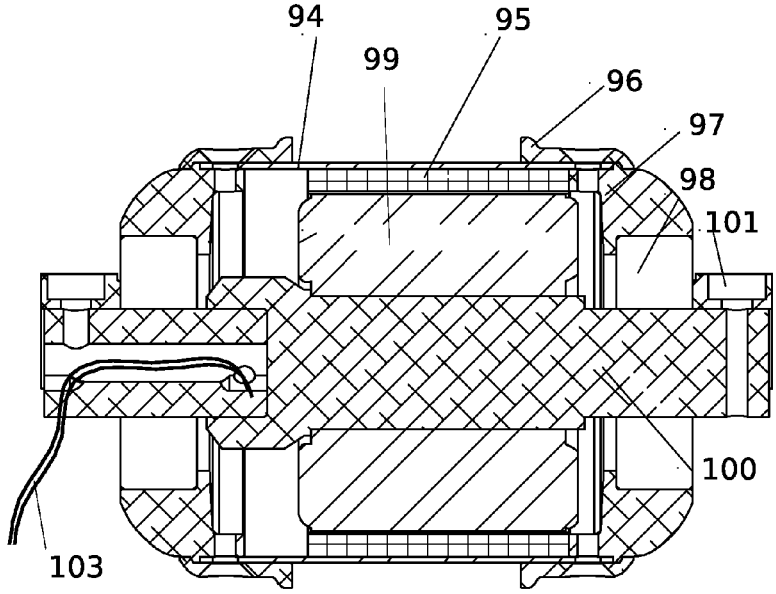
Fig.9c

POWERED SKATE WITH AUTOMATIC MOTOR CONTROL

CROSS-REFERENCE TO RELATED APPLICATION(S)

The present application claims priority to and the benefit of Provisional Application No. 61/617,635, filed Mar. 29, 2012, entitled "SKATING DEVICE WITH AUTOMATIC MOTOR CONTROL", the entire content of which is incorporated herein by reference.

FIELD

The present inventions relate to personal transportation devices including powered skating devices.

BACKGROUND

The motorized skates known to the art are largely operated manually by means of a throttle, joystick, foot switch or other manual controls. U.S. Pat. Publ. No. 2003/0141124 to Mullet, U.S. Pat. No. 7,204,330 to Lauren and U.S. Pat. No. 5,829,543 to Diaz and many others disclose a motor mechanically connected to a wheel of the skate by gears, belts, cables or other indirect mechanical couplings, where the motor is controlled by the rider by means of a hand throttle or other manual speed control means. The skating devices known to the art, both without motors or with motors with manual speed control, have the disadvantage of requiring considerable skill and practice to utilize effectively and are not stable and controllable enough to be widely used with safety in a environment where significant other foot or vehicle traffic is present.

U.S. Pat. No. 6,059,062 to Staelin and U.S. Pat. No. 7,481,291 to Nishikawa teach a skate with motors and a means to modify the operation in response to weight transfer. Directly controlling the motor on each skate by weight transfer commonly causes motor action in response to normal skating or stepping actions where weight shifts forward and back on each foot. So when this approach to motor control is used, the skates often work against each other or work inappropriately if the rider does not keep their feet close together or if the rider attempts to step or skate.

U.S. Pat. Publ. No. 2006/0170174 to Hiramatsu and U.S. Pat. Publ. No. 2006/0213711 to Hara and U.S. Pat. No. 6,050,357 to Staelin et al. and U.S. Pat. No. 7,138,774 to Negoro et al. and U.S. Pat. No. 5,487,441 to Endo et al and other similar references all disclose skateboards with load sensors. These methods allow a rider to control a skateboard by leaning, or by shifting weight forward or backwards. However, these techniques are not suitable for use in skates for the same reasons as described above.

A further disadvantage of motorized skates known to the art is the presence of gears, cogs, belts, chains or other indirect torque transfer methods that introduce friction and sufficient energy loss such that the wheels to which the motors are coupled are not capable of freewheeling in a practical manner. This means that skating without assistance from the motor is not practically possible due to the drag effect from the motor. U.S. Pat. No. 6,428,050 to Brandley discloses a skate with a motor consisting of a rotor that is also the wheel of the skate and a stator that is located outside. However, the small amount of magnetic coupling provided between rotor and stator will severely limit the torque possible from such a motor.

SUMMARY

Aspects of the invention relate to a powered skate with automatic motor control. In one embodiment, the invention relates to a system for controlling powered skates, the system including a pair of powered skates, each including a foot platform configured to receive a foot of a rider, a plurality of wheels coupled to the foot platform, a motor coupled to at least one of the plurality of wheels, the motor configured to rotate the at least one wheel, and a load sensor coupled to the foot platform and configured to sense an applied force, and a controller coupled to each of the motors and to each of the load sensors, the controller configured to control each of the motors, using a single algorithm, based on signals received from each of the load sensors.

In another embodiment, the invention relates to a system for controlling powered skates, the system including a powered skate including a foot platform configured to receive a foot of a rider, a front wheel coupled to the foot platform, a rear wheel coupled to the foot platform and positioned closer to an area of the foot platform for receiving a heel of the rider than the front wheel, a hub motor coupled to at least one of the front wheel and the rear wheel, the hub motor configured to rotate the at least one of the front wheel and the rear wheel, and a load sensor coupled to the foot platform and configured to sense an applied force, and a controller coupled to the hub motor and to the load sensor, the controller configured to control the hub motor based on a signal received from the load sensor.

In yet another embodiment, the invention relates to a system for controlling powered skates, the system including a powered skate including a foot platform configured to receive a foot of a rider, a plurality of wheels coupled to the foot platform, and a motor coupled to at least one of the plurality of wheels, the motor configured to rotate the at least one wheel, a motion sensor coupled to a body of the rider and configured to sense motion, and a controller coupled to the motor and to the motion sensor, the controller configured to control the motor based on a signal received from the motion sensor.

In still yet another embodiment, the invention relates to a method for controlling powered skates, the method including providing a pair of powered skates, each including a foot platform configured to receive a foot of a rider, a plurality of wheels coupled to the foot platform, a motor coupled to at least one of the plurality of wheels, the motor configured to rotate the at least one wheel, and a load sensor coupled to the foot platform and configured to sense an applied force, and controlling, using a controller coupled to each of the motors and to each of the load sensors, each of the motors, using a single algorithm, based on signals received from each of the load sensors.

BRIEF DESCRIPTION OF THE DRAWINGS

FIGS. 9*a*, 9*b* and 9*c* show illustrations of the isometric, side and section views of a hub motor used in accordance with one embodiment of the invention.

DETAILED DESCRIPTION

Various embodiments of the invention are described herein. Some embodiments of the invention include a pair of skates where each skate has sensors and a motor that turns at least one of its wheels; and at least one controller which changes the signals applied to both motors in response to input from the sensors.

Figure 1:
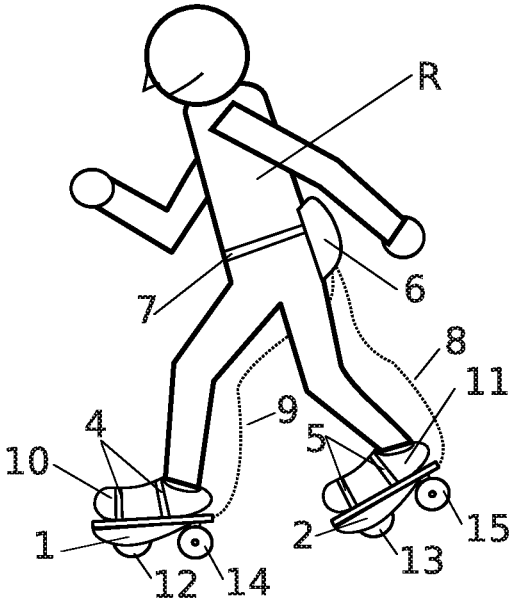
FIG. 1 shows a schematic side view of a person using a powered skate with automatic motor control in accordance with one embodiment of the invention.

FIG. 1 shows a schematic side view of a person using a roller skating device with automatic motor control in accordance with one embodiment of the invention. A rider R has a skate on each foot, hereafter referred to as skate 1 (1) and skate 2 (2). Each skate has a forward wheel 12 and 13 that contains a hub motor and at least one rear wheel 14 and 15. Each skate has straps 4 and 5 that secure the rider to the skate over the top of the rider's shoes 10 and 11. An enclosure 6 contains batteries and a motion sensor and is attached to the rider's body by means of a belt 7. The enclosure with the batteries and motion sensor on the rider are connected to each of the skates and by means of wires 8 and 9.

Figure 2:
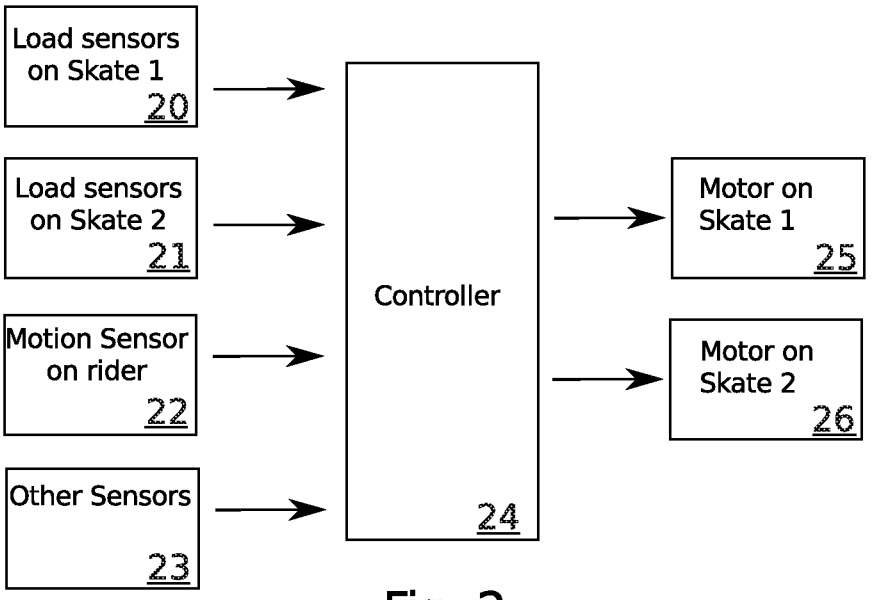
FIG. 2 shows a block diagram of a system for controlling a powered skate with automatic motor control in accordance with one embodiment of the invention.

FIG. 2 shows a block diagram of a system for controlling a powered skate with automatic motor control in accordance with one embodiment of the invention. The controller 24 receives signals from the load sensors 20 on skate 1, the load sensors 21 on skate 2, determines the desired torque for each motor 25 and 26 based on signals from both skates, and sends signals to the motor 25 on skate 1 and the motor 26 on skate 2 to cause each motor to generate the appropriate torque.

In some other embodiments of the invention, the controller receives signals from the load sensors on skate 1, the load sensors on skate 2 and motion sensors on the rider's body 22, determines the desired torque for each motor, and sends signals to the motors on skate 1 and skate 2. In some other embodiments, the controller may also use signals from other sensors 23 to determine the desired torque for each motor.

Figure 3A:
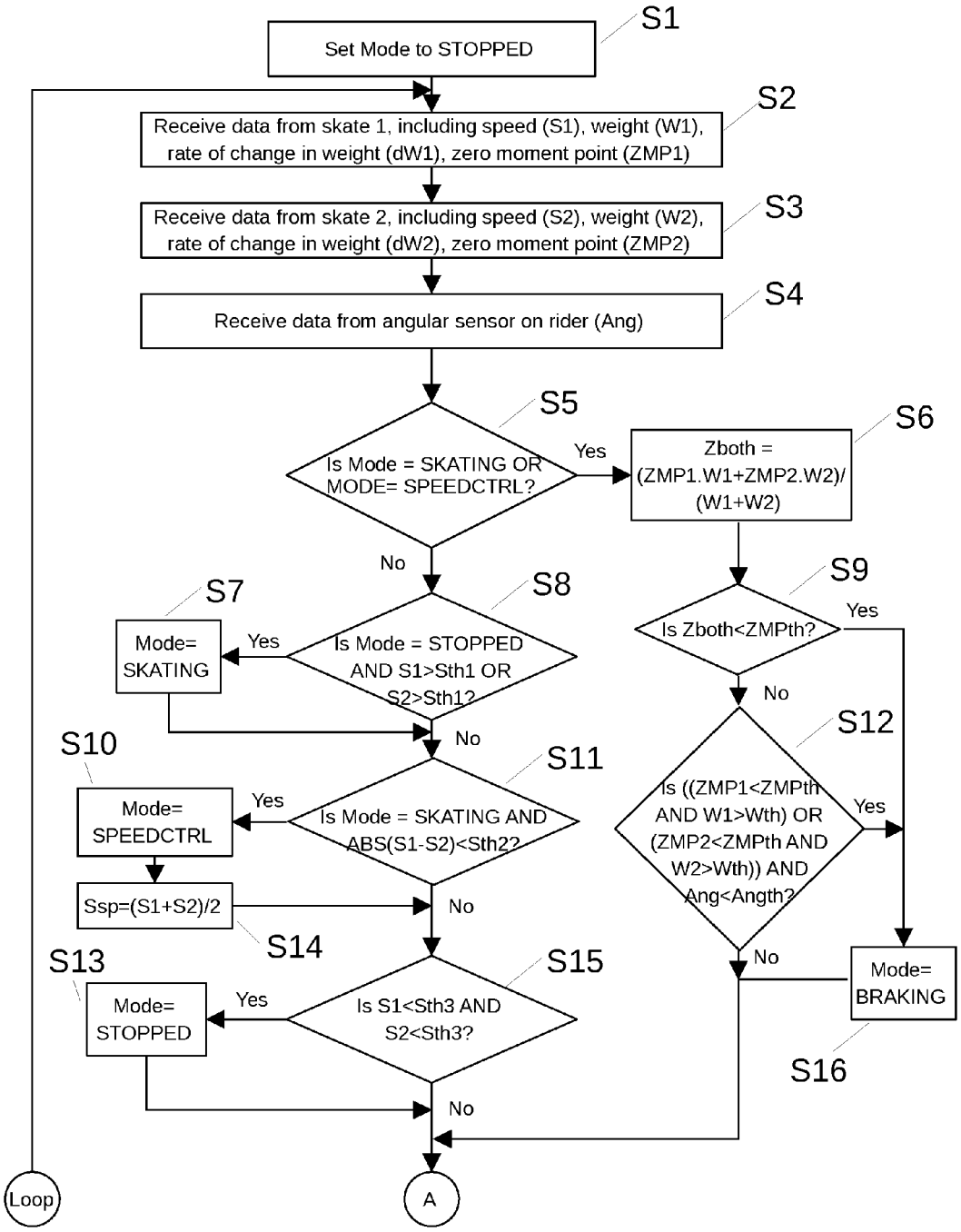
FIGS. 3*a* and 3*b* show a flowchart of a process for operating the controller of FIG. 2 in accordance with one embodiment of the invention.
Figure 3B:
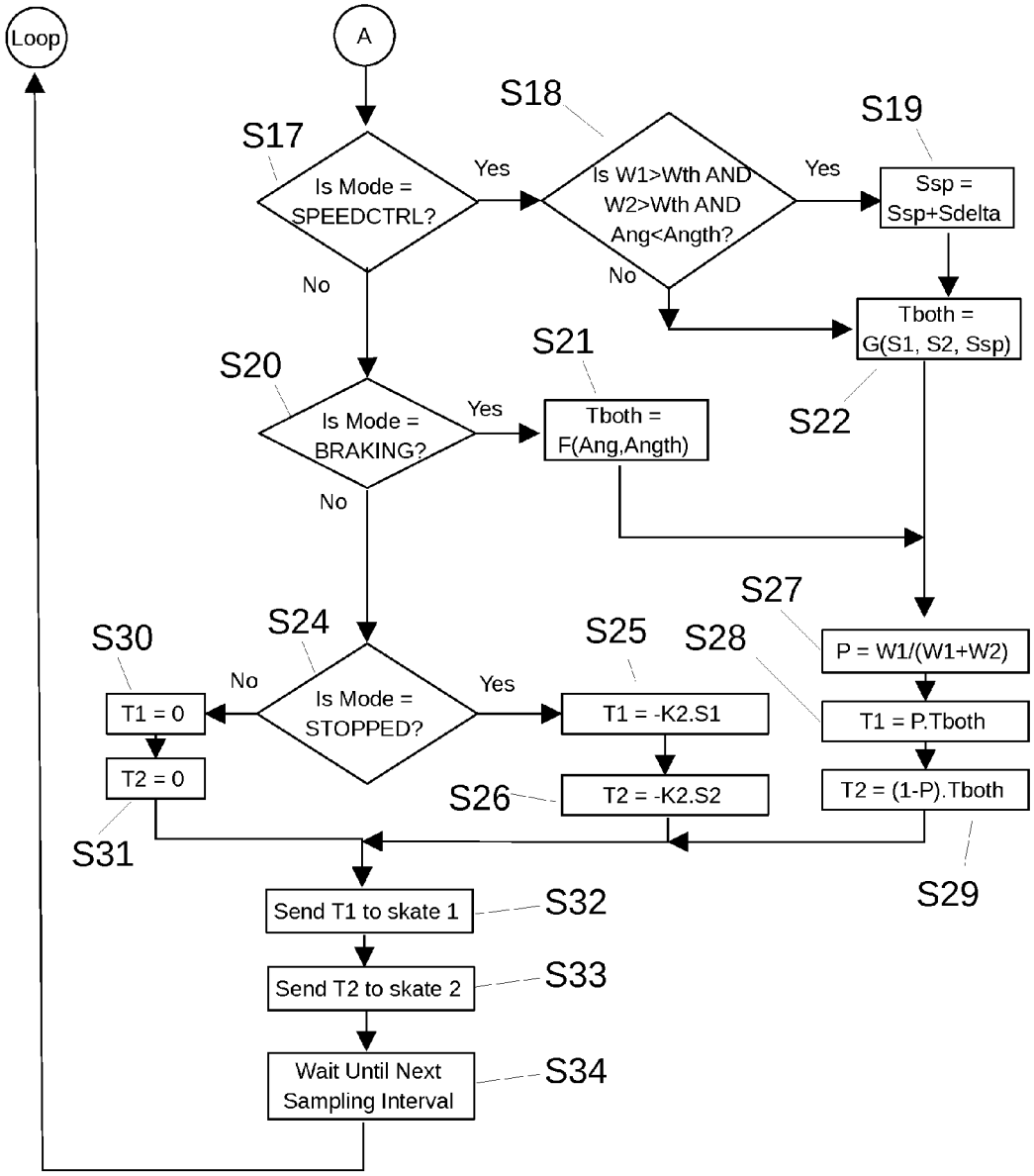

FIGS. 3*a* and 3*b* show a flowchart of a process for operating the controller of FIG. 2 in accordance with one embodiment of the invention. The main controller can execute a first sub-process (e.g., an algorithm) of the process to determine a mode of operation that depends on sensor inputs from both skates and the rider body angle sensor as illustrated in FIG. 3*a*, and a second sub-process (e.g., an algorithm) of the process to determine the torque output for both motors that depends on sensor inputs from both skates and the rider body angle sensor as illustrated in FIG. 3*b*.

In the embodiment illustrated in FIG. 3, the main controller executes a loop and at the end of the loop it waits until a certain time interval has passed since the last execution of the loop (S34), such that sensor data is processed at predetermined regular intervals. In some embodiments, this interval is in the range of about 0.02 to about 0.001 seconds. At every interval, the main controller receives (S4) signals from a motion sensor on the rider as described below, and receives (S2, S3) signals from each of the skates that reflect sensor inputs which may include speed, weight, rate of change of weight, and zero moment point (ZMP) as described below. At every interval, the main controller may also send (S32, S33) signals to each of the skates that cause each of the skates to generate torque in response to said signals.

In the embodiment illustrated in FIG. 3 the controller has the following four modes of operation: Stopped, Skating, Speed Control and Braking. The controller transitions between operating modes when certain conditions are met, these include:

1. Stopped mode to Skating mode (S7): if a skating action is detected making the speed of either of the skates above a certain speed threshold Sth1 (S8);
2. Skating or Braking to Stopped mode (S13): if the speed of both skates is below a threshold, Sth3 (S15);
3. Skating or Speed Control to Braking mode (S16): if the position of the rider's Zero Moment Point is behind a threshold ZMPth (S9); and
4. Skating to Speed Control mode (S10): if the absolute value of the difference between the measured speed of the two skates is less than a speed threshold Sth2 (S11).

The initial operating mode of the controller when it is first powered up can be a Stopped mode (S1).

In other embodiments the controller has the following four modes of operation: Stopped, Skating, Braking, and Balancing. The controller can transition between operating modes when certain conditions are met, including, for example:

1. Stopped mode to Skating mode: if a skating action is detected;
2. Skating to Stopped mode: if the speed of both skates is below a threshold;
3. Skating to Braking mode: if the rider's weight is behind a threshold;
4. Skating to Balancing mode: if the rider is in, or is close to being in, an unstable position;
5. Braking to Balancing mode: if the rider is in, or is close to being in, an unstable position; and
6. Balancing mode to Skating mode: the rider is in a sufficiently stable position.

In certain embodiments the controller has the following three modes of operation: Stopped, Skating, and Braking. The controller can transition between operating modes when certain conditions are met, including, for example:

1. Stopped mode to Skating mode: if a skating action is detected;
2. Skating or Braking to Stopped mode: if the speed of both skates is below a threshold; and
3. Skating to Braking mode: if the rider's weight is behind a threshold.

It is to be understood that the term controller refers to the means of generating outputs such as current in the motor windings or torque from sensor inputs such as motion or force. There are many means known to the art to implement such a controller, and any of them may be used with this invention. Examples include software executing a microprocessor or Digital Signal Processor (DSP) or functions programmed into a Field Programmable Gate Array (FPGA) or in hardware such as analog circuitry or an Application Specific Integrated Circuit (ASIC) or a combination of more than one of these connected together.

In certain embodiments the controller includes three digital signal controllers (DSCs), one on each powered skate and one on the battery enclosure on the rider, that all communicate with each other using a Controller Area Network (CAN). The controller is distributed among software executing on the different DSCs.

In certain embodiments, a controller on the battery enclosure operates as a master controller and controllers on each of the skates operate as slave controllers. Each slave controller receives signals from the sensors on that skate and can perform some processing such as digital filtering before passing the resulting sensor information to the master controller. Each slave controller further receives signals from the master controller that causes said slave controller to send signals to the motor to cause it to generate torque as commanded by the master controller. The master controller uses a single algorithm to determine the torque for both skates.

In certain embodiments, the controller has a Skating mode of operation in which the controller causes the motors to freewheel, producing (S30, S31) zero torque on both skates, and therefore not resist motion of the skates. This allows the rider to skate in the same manner as conventional skates without motors.

In certain embodiments, the controller causes the motor to freewheel by causing no current to flow in the motor windings. If the motor is a hub motor, in many cases, the friction resulting from the motor freewheeling may be negligible.

In certain embodiments, where motor friction is not negligible, the controller causes each skate's motor to generate torque in the direction of motion that simulates freewheeling by overcoming friction so that the rider's foot experiences closer to zero net force from the skate in the direction of rolling. In such case, no acceleration is caused by this freewheeling torque and the rider perceives the result as frictionless skating.

In certain embodiments, the controller has a Skating mode of operation in which the controller causes the motors to freewheel except when a certain stage of the skating action is detected, during which it causes one or both of the motors on the skates to generate forward torque.

A skate forward push is part of the normal skating action and is typified by the rider transferring weight from the rear foot to the front foot while pushing backwards and outwards on the rear foot.

In certain embodiments, the controller detects the stage of the skating action where the rider performs a normal roller skating forward push and causes the motors to generate additional torque in response.

In certain embodiments, the controller detects the stage of the skating action where the rider performs a normal roller skating forward push and changes parameters used to generate torque while the push is in progress.

In certain embodiments, the controller detects a skate push by comparing several measured values to thresholds. In certain embodiments, the controller detects a skate push by comparing relative speed of the two skates, weight on a skate and rate of change of weight on a skate to thresholds, for example:

IF ($S1-S2>St$) AND ($dW1>dWt$) AND ($W1>Wt$)
THEN SkatePush=1

ELSE IF ($S2-S1>St$) AND ($dW2>dWt$) AND ($W2>Wt$) THEN SkatePush=2

ELSE SkatePush=0 where S1 is the speed of skate 1, S2 is the speed of skate 2, W1 is the weight on skate 1, W1 is the weight on skate 2, dW1 is the rate of change of the weight on skate 1, dW1 is the rate of change of the weight on skate 2, and St, Wt and dWt are threshold values for the respective parameters. In such case, SkatePush=1 indicates that a push action is detected with skate 1 being the receiving skate and SkatePush=2 indicates that a push action is detected with skate 2 being the receiving skate and SkatePush=0 indicates that no push action is detected.

In certain embodiments, the controller has a Stopped mode of operation in which the controller causes the motors to generate torque to resist motion of the skates. This Stopped mode of operation can allow the rider the stand or take steps without unintentionally causing a skate to roll away from a stable position. It is not necessary to completely prevent the skates from moving to provide this benefit, but enough resistance can be created to allow the rider to balance themselves.

In certain embodiments, the motor torque that generates this motion resistance is calculated for each skate independently based on wheel position relative to a fixed position reference. The fixed position reference may be the recorded position of the wheel when the Stopped mode was entered. The wheel position may be determined from a wheel position sensor such as the magnetic encoder on the hub motor. In such case, it can be necessary to take into account full turns of the wheel when using such an encoder.

In some embodiments, when in stopped mode (S24), the torque that the controller causes the skate to generate to cause the motion resistance for that skate is calculated (S25, S26) proportionally to the measured speed of said skate:

$$T=-K\cdot S$$

where T is the torque for the skate, S is the measured speed of the skate, and K is a constant chosen to produce the desired level of resistance.

In certain embodiments, the torque used to cause the motion resistance is calculated using a Proportional plus Derivative (PD) rule based on the position and speed of the wheel. For example:

$$T=K1\cdot(X-Xs)+K2\cdot dX/dt$$

where T is motor torque, X is wheel position and Xs is the position reference and K1 and K2 are constants that depend on the implementation. In certain embodiments, K1 may equal zero such the skate only resists movements while it is in motion. In certain embodiments, the position used to determine torque has a Dead Zone, where K1 is 0 for small values of (X−Xs). In certain embodiments, the position reference Xs is altered to limit the maximum torque requested.

It is to be understood that the torque required to cause the disclosed motion resistance effect can be calculated using a variety of methods known to the art, of which the above are simply examples of some of those methods.

In some embodiments, the controller passively generates the motion resistance torque by the causing the motor driver to connect both ends of a winding together such that whatever current is generated by the motor turning continues to circulate in the winding and therefore generates torque to oppose the motion. This method has the advantage of not requiring power to be drawn from the battery.

In some embodiments, the controller switches between actively and passively resisting motion, for example, the motion resistance becomes passive after being in Stopped mode for a certain amount of time.

In certain embodiments, the controller also causes the motor to apply torque to resist motion of the skate in the reverse direction regardless of the operating mode.

A system that tilts can be actively balanced by regulating the tilt to near the vertical position, which is well known to be achieved by a control law with a proportional plus derivative action. However, a system that does not tilt, for example a rider on platform such as a skateboard or rollerskate, generally must be treated more like a rigid body. An appropriate concept to the balancing of rigid bodies is that of Zero Moment Point. It is to be understood that the term 'Zero Moment Point' and its abbreviation 'ZMP' are taken to mean the point on the surface of the Foot Platform where the effect of all the forces acting on the rider from the platform can be replaced by a single force. This is consistent with the industry use of the term ZMP as defined by Vukobratovic and Borovac ('Zero-Moment Point' in international journal of humanoid robotics. Vol. 1, No. 1 (2004) 157-173), which is incorporated herein by reference in its entirety.

For example, when the platform is at rest, the ZMP on the platform's surface is the point vertically below the rider's center of mass, meaning that the moment about that point on the platform's surface is zero. If the rider's foot is secured to the platform and the ZMP is outside of the ground contacting elements of the platform, for example, in front of the front-most wheel, then the platform will tip over. The control problem of balancing a rider on a platform is therefore the problem of maintaining the ZMP within the zone of stability within the ground contacting elements.

In some embodiments, controller sends signals to the motor on a skate to generate torque to resist acceleration when the direction of the acceleration of that skate is currently towards a position that will make the rider unstable.

For example, when the ZMP on a skate is in a forward end of the skate, and the skate is accelerating in the reverse direction, the rider would perceive this as having the foot slip backwards in an unintended way. In this example, if the skate moves far enough in the reverse direction, then the rider's leg will pivot forwards and be unable to support weight, lifting the rear of the skate off the ground. The controller can determine whether acceleration is in the direction that will make the rider unstable by comparing the acceleration and ZMP of each skate to certain thresholds.

In some embodiments, the additional torque T that the controller causes to be generated at one of the skates is determined as a predetermined function M of both acceleration and the location of the rider's ZMP on that skate:

$$T=M(A,Z)$$

where Z is the ZMP of the skate with acceleration A. An example for the function M may be represented in pseudo code as follows:

IF $A1>th1$ AND $ZMP1<th2$ THEN $T=k\cdot(A-Ath1)$

IF $A1<th3$ AND $ZMP1>th4$ THEN $T=k\cdot(A-Ath3)$ where Ath1 is a forward acceleration threshold and Ath3 is a negative acceleration threshold and th2 is a ZMP threshold near the rear of the skate and th4 is a ZMP threshold near the front of the skate and k is a scaling factor that depends on the specific embodiment.

In some embodiments, the controller calculates the measured values of acceleration by means such as differentiation or Kalman filtering. In other embodiments, the values used for A-th1 and A-th3 may be estimated as the difference between the skate's measured or calculated speed and a rate limited version of that same speed.

In certain embodiments, the main controller sums one torque value for each skate, which it may have calculated by function M to resist acceleration when the direction of the acceleration of that skate is currently towards a position that will make the rider unstable, with another torque value which the main controller has calculated using other algorithms, such as from the process illustrated in FIG. 3. In some embodiments, main controller may sum the combined torque values from multiple calculations to determine a final value.

In some embodiments, the skate system includes a sensor system for measuring the motion of the rider's upper body. The controller receives signals from the motion sensor system and in response sends signals that cause torque in the motors.

In some embodiments, the skate system includes a sensor system for measuring the angle or angular rate of change of the rider's upper body. The sensor system can be affixed to the rider's body in a location where the angle or angular rate of the sensors will substantially match that of the rider's torso.

In one embodiment, the sensor system is fixed within an enclosure (e.g., component 6 in FIG. 1) that is affixed to a belt around the rider's waist and hangs below the rider's belt on the rider's back. A bag intended for use in this location is sometimes referred to as a 'fanny pack'. In other embodiments, the sensor system may be positioned directly on a belt around the rider's waist, or in a bag strapped to the rider's back, or on straps or webbing around the rider's back and shoulders, or incorporated within a structure that straps to the rider's back and legs in the manner of a sporting tail-bone protection device, or secured to the rider in any location above the legs. In some embodiments, the sensor system may be located without a structure secured on the rider's back at about the level of the top of the rider's buttocks.

In some embodiments, the sensors are configured to measure angle in the forward-reverse direction, and in other embodiments, the sensors are further configured to also measure angle in the side to side direction. In some embodiments the angle sensor is a micro electro-mechanical (MEMS) gyroscope that measures angular rate. In some embodiments the motion sensor is a accelerometer that measures force due to gravity in at least one axis to determine how far the rider's upper body has tilted in the forward-reverse direction from the vertical position or some reference position.

In some embodiments the motion sensor system is a combination of a gyroscope and an incline sensor or acceleration sensor. Multiple sensor readings may be combined into a single measurement of tilt, and also possibly a measurement of tilt rate of change. Many means of combining multiple angular sensors into a single measurement are well known to the art, including a Kalman filter. It is to be understood that other equivalent means of measuring angle or angular rate or tilt may be used.

It is to be understood that motor torque, motor current and motive force are closely related by the physics of the structure of the vehicle, and therefore disclosure of control methods that use motor torque should also be understood to also disclose the same methods using motor current or motive force.

In some embodiments and as discussed above, the controller has a Braking Mode, in which the controller causes reverse torque to be generated by the motors to slow the rider's forward motion.

In some embodiments, the controller enters Braking mode when the rider's ZMP across both skates in the forward-reverse direction passes behind a threshold ZMPth (S9). The ZMP can be filtered by a low pass filter such that fluctuations or short movements in the rider's ZMP do not cause the controller to enter Braking mode. In some embodiments, this ZMP filter has a corner frequency of 1 Hz.

In some embodiments, the overall ZMP across both skates is determined as follows (S6):

$$Z\text{both}=(ZMP1\cdot W1+ZMP2\cdot W2)/(W1+W2)$$

where Zboth is the combined ZMP, ZMP1 is the ZMP of the rider on skate 1, ZMP2 is the ZMP of the rider on skate 2, W1 is the weight on skate 1 and W2 is the weight on skate 2. In some embodiments, the controller only needs to calculate Zboth if it is in skating the speed control modes (S5). In some embodiments, the controller may enter Braking mode in response to the rider's torso lean passing behind a threshold.

In some embodiments, the controller enters braking mode in response to detecting that the rider is lifting the front wheel on one skate while still having weight on it and is also leaning back (S12). This may be implemented using the following comparisons:

$$((ZMP1<ZMPth\ AND\ W1>Wth)\ \text{OR}\ (ZMP2<ZMPth\ \text{AND}\ W2>Wth))\ \text{AND}\ Ang<AngTh$$

where ZMP1 is the ZMP of the rider on skate 1, ZMP2 is the ZMP of the rider on skate 2, W1 is the weight on skate 1 and W2 is the weight on skate 2, Wth is a threshold indicating that at least some weight is on that foot, Ang is the torso angle of the rider, and AngTh is a torso angle threshold that indicates a backward lean. The thresholds used in this comparison may be set so that the detected posture is similar to the one adopted by a rider attempting to use the heel brake of a conventional inline skate.

In some embodiments, once braking mode has been entered, the controller can return to skating mode in response to measurements including the lean angle of the rider exceeding a certain threshold in the forward direction, or the rider's ZMP passing in front of a threshold, or the rider's lateral weight distribution passing outside certain thresholds. In other embodiments, such as that represented by FIG. 3, the controller can only exit braking mode by entering stopped mode.

In some embodiments, when in braking mode (S20), the controller calculates the total required torque using a function of rider angle and rider angle threshold (S21), as follows:

$$T\text{both}=F(Ang,Angth)$$

where Ang reflects rider body angle, Angth is a rider body angle threshold reflecting the rider's body angle in an approximately upright position and F is a function. Function F may be a linear factor of distance from the threshold as follows:

$$F(Ang,Angth)=K\cdot(Ang-Angth)$$

where K is a predetermined constant.

In some other embodiments, the function F may have other parameters, such as the time derivative of the rider body angle and may implement a PD control system. The control problem of balancing a rider on a mobile platform by applying force at the ground and measuring angle is well known to those skilled in the art of control systems, and is often called the inverted pendulum, and numerous control systems can be applied, including Proportional+Derivate (PD), optimal Linear Quadratic Regulator (LQR) and Model Predictive Control (MPC).

In some embodiments, when the controller is causing the motors to provide torque, the controller changes the distribution of torque across the two skates in response to certain measured parameters. Examples of when this might be beneficial is if most of the rider's weight was substantially on one foot during a stepping or skating action.

In certain embodiments, the torque between the two skates is allocated such that the total torque produced is a value that the controller has previously determined by one or a combination of methods, such as those disclosed herein.

In some embodiments, the controller changes the distribution of torque across the two skates in response to weight distribution across the two skates. For example, the torque distribution may be determined as follows (S27):

$$P=W1/(W1+W2)$$

where P is a proportion of torque allocated to skate 1 and W1,W2 reflect a weight on skates 1 and 2, respectively. The P value may then be used as follows (S28, S29):

$$T1=P\cdot T\text{both}$$

$$T2=(1-P)\cdot T\text{both}$$

where T1,T2 reflect the torque allocated to skate 1 and skate 2, respectively, and Tboth represents a total torque calculated by the controller.

The torque distribution may also be determined from a non-linear function of weight distribution, H, for example:

$$P=H(W1,W2)$$

The function H used can also depend on the mode of operation of the controller or on other measured inputs.

In some embodiments, the controller changes the distribution of torque across the two skates in response to the speeds of the two skates. For example, the allocation may depend on the difference in speed between the two skates such that more torque is applied to the slower skate causing them to be driven towards each other.

In some embodiments, the controller changes the distribution of torque across the two skates in response to changes in the relative position of the two skates. For example, the allocation may depend on the difference in position between the two skates such that more torque is applied to the rearward skate causing them to be driven towards each other. The controller may determine the relative position of the skates by using the rotation sensors to determine how far each skate has moved from a reference position.

In some embodiments, the controller allocates a total torque across the two skates in response to what stage the rider is at of the skating action.

The total torque that the controller causes the two motors to apply may be determined by a variety of means, such as a combination of those described previously, and may also depend on the mode of operation of the controller.

In some embodiments, the controller has a speed control mode of operation where it causes at least one motor to generate torque to control the speed of the rider to a certain speed. The speed of each skate may be measured directly by means of a speed sensor, or it may be calculated from other measurements, using methods well known to the art, which may include the motor's rotor position, the motor's rotor's magnetic field, or voltages generated in the motor windings.

In embodiments where there are two skates, the rider speed is determined by a combination of the speeds of the two skates. In some embodiments, this combination is the mean value (S14). In other embodiments, this combination is a weighted average weighted by the load (e.g., weight) measured on each skate. In some conditions, this combined speed may just be the speed of one of the skates, for example if the other is lifted off the ground.

In the embodiment illustrated in FIGS. 3*a* and 3*b*, the torque is calculated (S22) as a function of the skate speeds 51 and S2 and the speed set point Ssp as follows:

$$T\text{both}=G(S1,S2,Ssp)$$

The relationship represented above as G that the controller applies between the combined motor torque and the speed set point and the measured or calculated speed can have other inputs or other state and can reflect any of a number of control systems for speed control well known to the art, including methods such as Proportional+Integral+Derivative control or Model Predictive Control. The rate at which the controller permits the speed to change may be limited using ramp-up and ramp-down methods well known to the art.

In some embodiments, where the combined speed of the skates exceeds the speed set point (e.g., such as when descending a hill), the controller causes reverse torque to be applied by the skate motors resulting in a braking action. In some embodiments, the braking action is regenerative resulting in power being stored into the battery.

In some embodiments, the controller sets the speed set point, and enters and exits the speed control mode when it detects certain phases of the skating action. For example, the controller may enter speed control mode when the difference between the weights measured in each skate is less than a threshold; and, upon entering speed control mode, also set the speed set point to the current rider speed (S19). For example, the controller may enter speed control mode when the following condition is met (S11):

$$\text{ABS}(S1-S2)<Sth2$$

where S1 and S2 reflect the speeds of each skate, and Sth2 is a speed threshold. In some embodiments, this speed threshold is a value in the range of about 0.05 to about 0.5 meters/second or m/s. In some embodiments this speed threshold is about 0.1 m/s.

In some embodiments, he controller can leave speed control mode when the difference between the weights measured in each skate is greater than another threshold. The controller may calculate the thresholds for entering and leaving speed mode as a proportion of the total rider weight.

In some embodiments, the speed set point may be set or adjusted by means of user input, such as from a remote control, a knob, a wireless signal from a hand-held computing device or other form of user interface known to the art. For example, a hand held control box with two buttons may be used by the rider to adjust the speed set point, where pressing one button causes an increase in speed set point, while pressing the other button causes a decrease. The hand held control box may be wired to the controller or it may use wireless communications.

The controller may also enter or leave speed control mode in response to an external signal, such as from a button, a remote control, a hand switch, a wireless signal from a hand-held computing device or other form of user interface known to the art.

This manual control of the speed control mode and set point may be employed in situations where constant speed is desired, such as when making a motion picture or other video recording.

In some embodiments, the controller increases the speed set point while in speed control mode upon detecting specific rider actions. For example, the rider leaning forward with both feet on the ground causes the controller to increase the speed set-point.

In some embodiments, when the controller is in Speed Control mode (S17), the speed set point may be adjusted as follows (S18, S19):

$$\text{IF } W1>Wth \text{ AND } W2>Wth \text{ AND } Ang<AngTh \text{ THEN}$$

$$Ssp=Ssp+\text{Sdelta}$$

where W1,W2 reflect the weight on skates 1 and 2 respectively, Wth is a threshold indicating that at least some weight is on that foot, Ang reflects the body angle of the rider, AngTh is a body angle threshold that indicates a forward lean, Ssp is the speed set point, and Sdelta is a preselected change in Ssp over a preselected sampling interval.

In some embodiments, each skate's ZMP is compared to a threshold to determine if the speed set point should be adjusted. The ZMP comparison may be done in addition to the weight and angle comparisons, or may replace the weight comparison as follows:

$$\text{IF } ZMP1<ZMPth1 \text{ AND } ZMP2<ZMPth1 \text{ AND } ZMP1>ZMPth2 \text{ AND } ZMP2>ZMPth2 \text{ AND } Ang<AngTh \text{ THEN}$$

$$Ssp=Ssp+\text{Sdelta}$$

where ZMP1 reflects the ZMP of the rider on skate 1, ZMP2 reflects the ZMP of the rider on skate 2, ZMPth1 and ZMPth2 are ZMP thresholds that can be set such that they reflect a condition where the rider is in a stable and centered position, Ang is the torso angle of the rider, AngTh is a torso angle threshold that indicates a forward lean, Ssp is the speed set point, and Sdelta is the change in Ssp over the preselected sampling interval.

Figure 4:
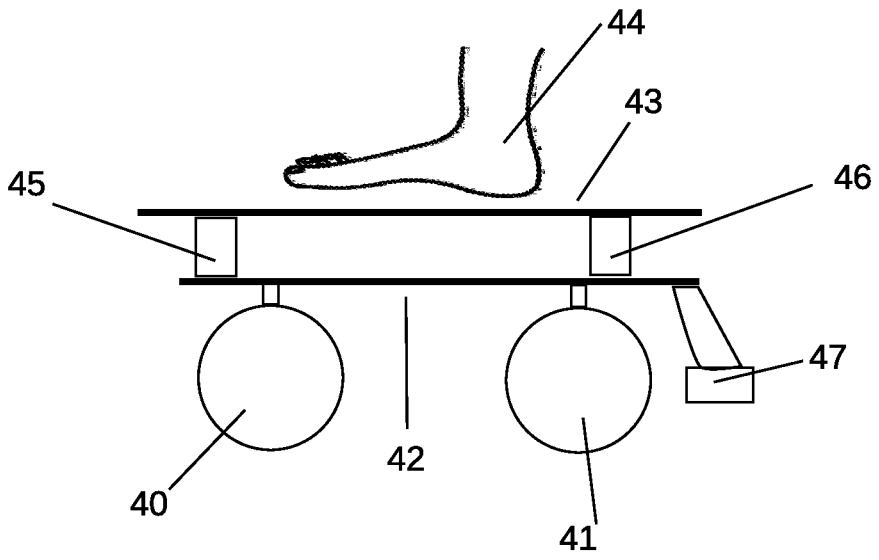
FIG. 4 shows a schematic side view of a powered skate with automatic motor control and a foot of a person in accordance with one embodiment of the invention.

FIG. 4 shows a schematic side view of a powered skate with automatic motor control and a foot of a person in accordance with one embodiment of the invention. At least two wheels are rotationally coupled to a chassis 42 such that at least one wheel 40 is in front of the center of gravity of the rider in a stationary posture and at least one wheel 41 is behind the center of gravity of the rider. At least one of the wheels has a motor attached to it (not shown). A foot platform 43 is disposed for a rider to place a single foot 44 on. The foot platform and the chassis are coupled to each other in a manner which includes a plurality of load sensors 45 and 46 disposed such that the both the total weight and forward/reverse weight distribution can be measured.

In most embodiments, the coupling between the upper and lower platforms does not distort under load substantially so that the two platforms do not tilt appreciably relative to each other. In some embodiments, the load sensors are of a type such that each is substantially sensitive to only vertically oriented loads. In other embodiments, the load sensors are disposed such that they are only substantially subject to vertically oriented loads, while loads in the lateral or forward/reverse directions being carried by other support members (not shown).

The load sensors 45 and 46 are illustrated as disposed above the chassis 42, but they may also be disposed within or below the chassis and attached to the foot platform 43 by vertical members that are not themselves supported by the chassis.

In some embodiments, a brake 47 is attached to the chassis. The brake can operate in the manner of rear skate brakes known to the art. The brake 47 is disposed along the chassis 42 such that if the entire skate is tilted backwards, the bottom of the brake will contact the ground surface and the resulting friction resists motion. It is understood that structures implementing any of the braking methods for skates known to the art can be used here.

Figure 5:
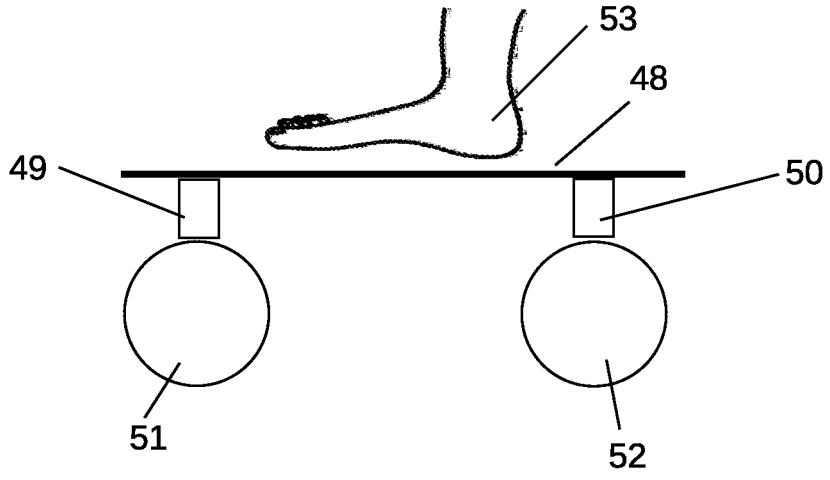
FIG. 5 shows a schematic side view of a powered skate with automatic motor control and a foot of a person in accordance with another embodiment of the invention.

FIG. 5 shows a schematic side view of a powered skate with automatic motor control and a foot of a person in accordance with another embodiment of the invention. In this case, the skate includes only a single platform 48 and the load sensors are disposed in the couplings 49 and 50 between the wheels 51 and 52 and the platform. The platform 48 is disposed for a rider to place a foot 53 on. At least one of the wheels has a motor attached to it (not shown). The coupling 49 and 50 between each of the wheels and the platform may use any rotational coupling method known to the art, including, for example a skateboard truck with a load sensor disposed in each of the coupling assemblies between the wheels and the platform in such a way as to measure the vertical load carried by the coupling.

The coupling between the wheels and the platform may use a vertical force sensing coupling. The vertical force sensing coupling is an assembly of parts that is substantially rigid in all directions and provides a measurement of force in substantially only the vertical direction. In some embodiments, the vertical force sensing coupling consists of a plurality of linear guides and a load cell that are all coupled between the front wheel and the platform. The linear guides can be constructed such that they do not transfer any substantial force in the vertical direction, while not allowing any rotation or any substantial movement in the horizontal plane. The load cells are therefore subject to substantially all of the vertical force supporting the platform.

In other embodiments, the vertical force sensing coupling has a hinge or other mechanical structure that provides support in the forward/reverse and lateral directions, and transfers substantially all of the vertical forces to a load cell or other force sensor.

It is to be understood that the term 'load sensor' can refer to any sensor assembly that gives a measurement the amount of force applied to it, a wide variety of which are known to the art. In some embodiments, the load sensor can include, without limitation: a strain gauge affixed to a structural member, pressure sensitive resistive material, a membrane switch with resistance that depends on pressure, piezoelectric material, and/or combinations thereof.

Figure 6A:
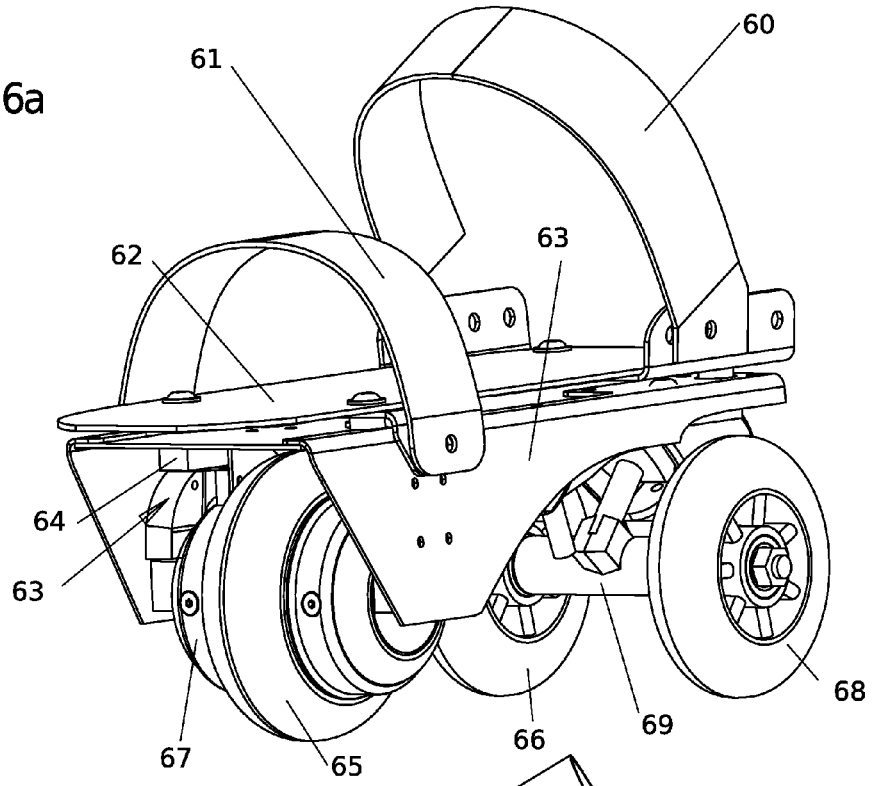
FIGS. 6*a* and 6*b* show illustrations of the isometric and side views of a powered skate with automatic motor control in accordance with one embodiment of the invention.
Figure 6B:
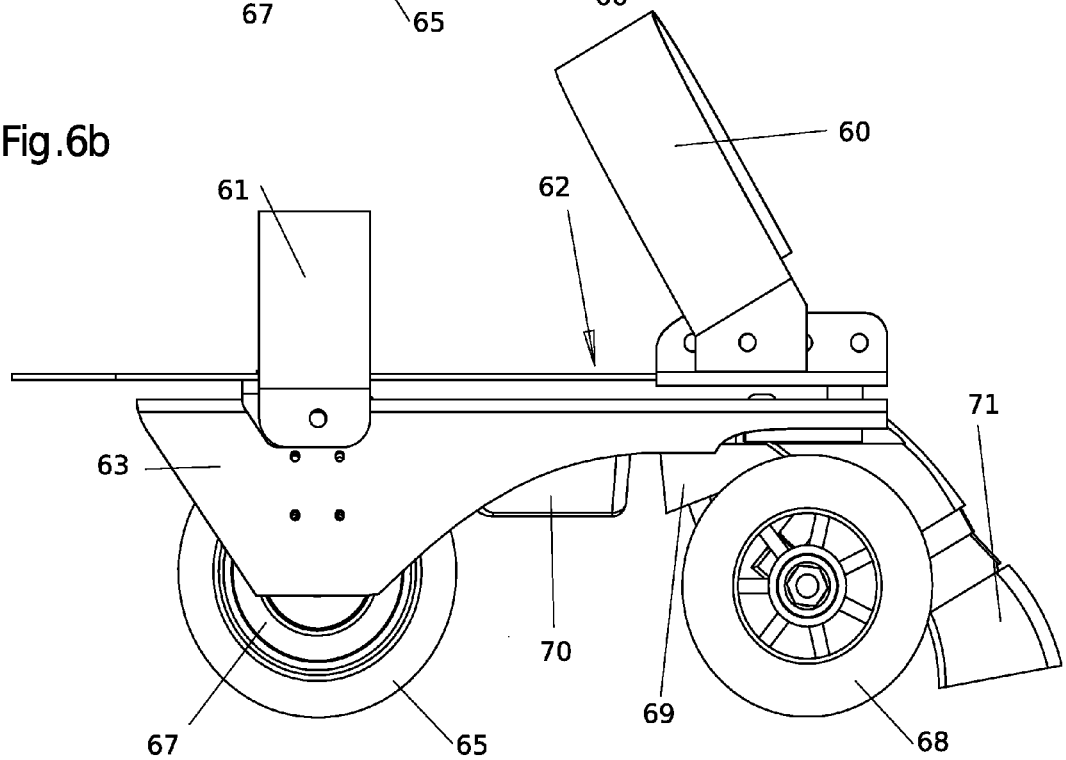

FIGS. 6*a* and 6*b* show illustrations of the isometric and side views of a skate with automatic motor control in accordance with one embodiment of the invention. A foot retention mechanism secures the rider's foot to the platform 62. In the embodiment illustrated in FIG. 6*a* and FIG. 6*b*, the foot retention mechanism includes an ankle strap 60 and a toe strap 61. The ankle strap 60 secures the rear part of the rider's foot and ankle to the platform 62. The toe strap 61 secures the forward part of the rider's foot to the platform 62. The straps are of adjustable lengths and are disposed in such a way as to secure the foot to the platform whether or not the rider's foot has a shoe on it.

A variety of different foot restraining mechanisms can be employed to serve as the foot retention mechanism, including straps in a variety of configurations, with and without fasteners such as clasps, buckles, laces or hook-and-loop material; or a flexible material can partially envelope the foot in the manner of a shoe and be secured by straps or laces.

The foot platform 62 is a largely flat structure that is configured to fully support the rider's foot. The individual skates intended for the left and right foot of the rider may have the foot platform and straps disposed in the mirror image of each other to match the configuration of human feet.

In the illustrated embodiment the ankle straps may be fastened to the foot platform at different locations to allow fitting of various sized feet. In some embodiments, the rearward portion of the foot platform 62 and the ankle straps (60, 61) may be slidably disposed relative to the forward part of the Foot Platform and the Foot Straps to allow appropriate securing of feet of different sizes. In some embodiments, further ankle support members and a strap are attached to the foot platform.

The Chassis 63 is a supporting structure to which other elements are attached.

In the illustrated embodiment, the load sensors are implemented with four load cells 64 that are each fixed to the chassis at one end and the foot platform at the other end, such that in combination they provide the entire support for the foot platform, and such that in combination measure the entire weight applied to the foot platform. In some embodiments, the foot platform is rigid enough so that intended loads do not cause its shape to distort which may adversely affect the load sensor measurements.

In the illustrated embodiment, wheel 66 is rotationally coupled to the chassis in a position substantially to the right and rear of the rider's center of gravity and another wheel 68 is rotationally coupled to a platform in a position substantially to the left and rear of the rider's center of gravity. The rear wheels (66, 68) are rotationally coupled to the steerable truck 69. The steerable truck 69 is of a design well known to the art and widely used in roller-skates and skateboards; it is fixed to the chassis by two offset couplings, one permits rotation and one permits both lateral tilting and rotation, such that lateral tilting induced by lateral weight distribution causes a steering effect from the truck.

In the illustrated embodiment, the front wheel 65 is driven by a hub motor 67 that is coupled to the chassis 63 in a position in front rider's center of gravity and laterally substantially in the center of the platform. The hub motor 67 and the sensors are electrically connected to control electronics which are located within an electronics enclosure 70.

In other embodiments, the control electronics can be located at any of several suitable locations attached to the chassis. The control electronics can also be connected to a battery or batteries; the battery or batteries may be located at any of several locations attached to the chassis, or may be located remotely from the powered skate, for example, attached to the rider's back or belt.

The wheel configuration used in the illustrated embodiment of a powered frontward wheel with two laterally place rearward wheels has an advantage as compared to conventional skates which have the rear wheel powered. For the conventional skates, forward stepping or skate push action lifts the powered wheel off the ground after the un-powered wheels, such that there is normally no time during which the rider is pushing against an un-powered wheel. As a result of being un-powered, such a wheel on a conventional skate cannot provide speed control or resist destabilizing motion.

In some embodiments, a brake is attached to the rear of the skate such that it will contact the ground if the rider is sufficiently out of balance to lift the powered front wheel off the ground and cause a significant tilt of the skate. In some embodiments, the brake is attached to the rear of the steerable truck. In the embodiment illustrated in FIGS. 6*a* and 6*b*, a brake 71 is attached the rear of the chassis. In several embodiments, the brake is disposed so that it will contact the ground if there is a significant tilt of the skate.

The brake 71 can function to help prevent loss of balance of the rider when the motorized front wheel has lifted off of the ground. If this occurs while in forward motion, the friction of the brake on the ground will cause deceleration resulting in a forward shift of the rider's weight causing the motorized front wheel to resume contact with the ground.

Figure 7A:
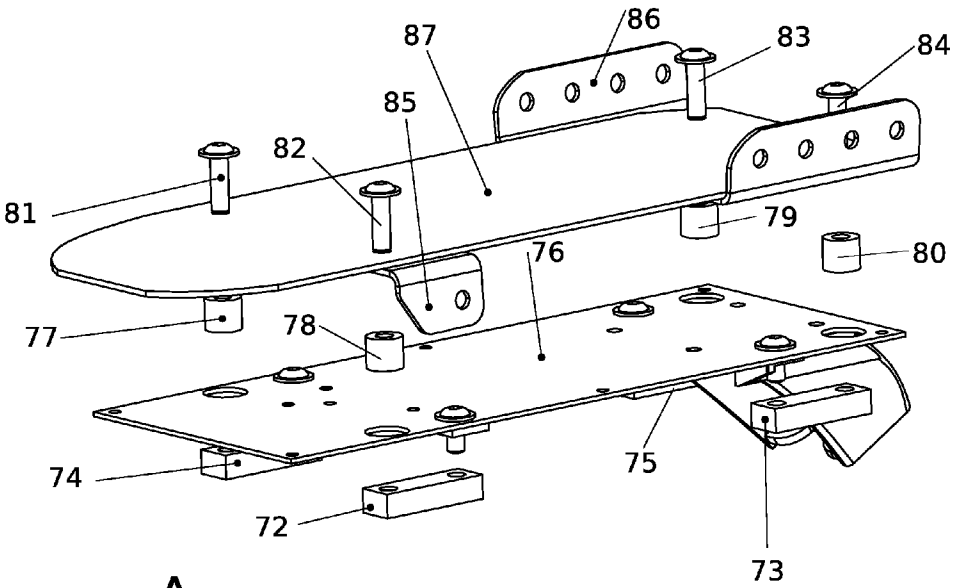
FIGS. 7*a*, 7*b* and 7*c* show exploded isometric, front and side sectional views of the foot plate, chassis and load cell assembly of a powered skate with automatic motor control in accordance with one embodiment of the invention.
Figure 7C:
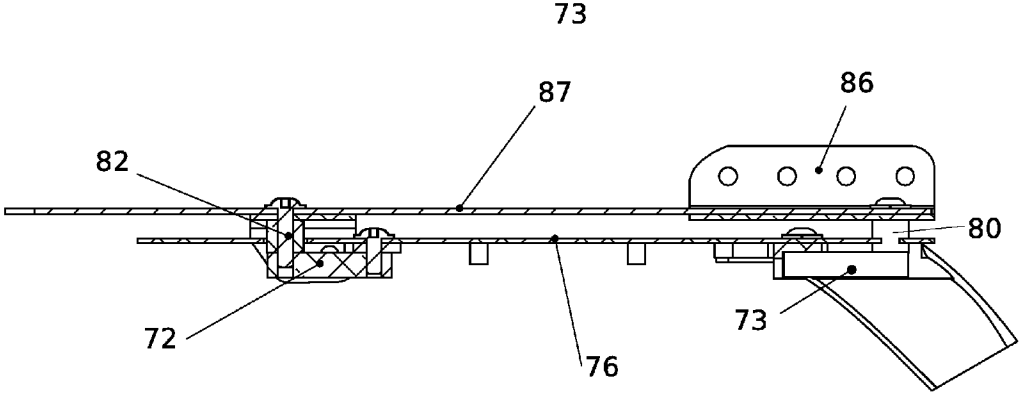
Figure 7B:
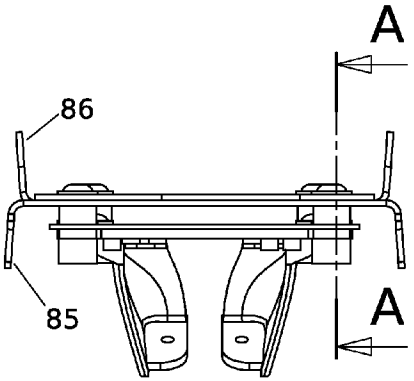

FIGS. 7*a*, 7*b* and 7*c* show exploded isometric, front and side sectional views of the foot plate, chassis and load cell assembly of a powered skate with automatic motor control in accordance with one embodiment of the invention. The load cells are implemented with a strain gauge bonded onto a metal bar. The skate includes four load cells (72, 73, 74, 75) having a rectangular block shape. Each load cell (72, 73, 74, 75) is secured to the underneath of the chassis 76 at one end of the block shape. On the other end of the block shape of each load cell (72, 73, 74, 75) there is a spacer (77, 78, 79, 80) which extends upwards through a hole in the chassis to the foot platform 87. The spacers, load cells and foot platform are fixed together by a bolt (81, 82, 83, 84). The foot platform 87 also has flanges 85 and 86 for fixing straps or other foot retention mechanisms.

In the embodiment of FIGS. 7*a*, 7*b*, 7*c*, the load cells are disposed such that they alone support the foot platform with no load supported by any other members. The load cells are disposed such that each bends in proportion to the load it supports and the strain measured by each strain gauge incorporated within each load cell is proportional to the load supported by that load cell.

In some embodiments there are four load sensors, each disposed substantially in one corner of the foot platform 87. In other embodiments there are three load sensors, one of which is in the lateral center at the front or rear. In other embodiments there are two load sensors, one to the front and one to the rear.

In some embodiments, the powered skate has two front wheels. In such case, either one or both of the front wheels is driven by a motor, either a directly coupled motor such as a hub motor or a motor indirectly coupled by means of a belt, chain or gears. The two front wheels and at least one rear wheel are rotationally coupled to a chassis. In some embodiments, the two front wheels are rotationally coupled to a steerable truck, which is coupled to the chassis.

It is to be understood that in some embodiments of this invention, the shape of the physical structures will vary, and that additional structures may be present to improve the cosmetic appearance beyond that represented herein or to provide additional functionality not discussed herein.

In some embodiments, the powered skate includes a hub motor. In such case, the hub motor has a stator that is fixed to the skate and a rotating part that is fixed to a ground contacting element and the rotating part is rotationally fixed to rotate around the outside of the stator. A hub motor is different from a conventional motor, in which the rotating part rotates inside the stator and transfers torque through a shaft.

Figure 8:
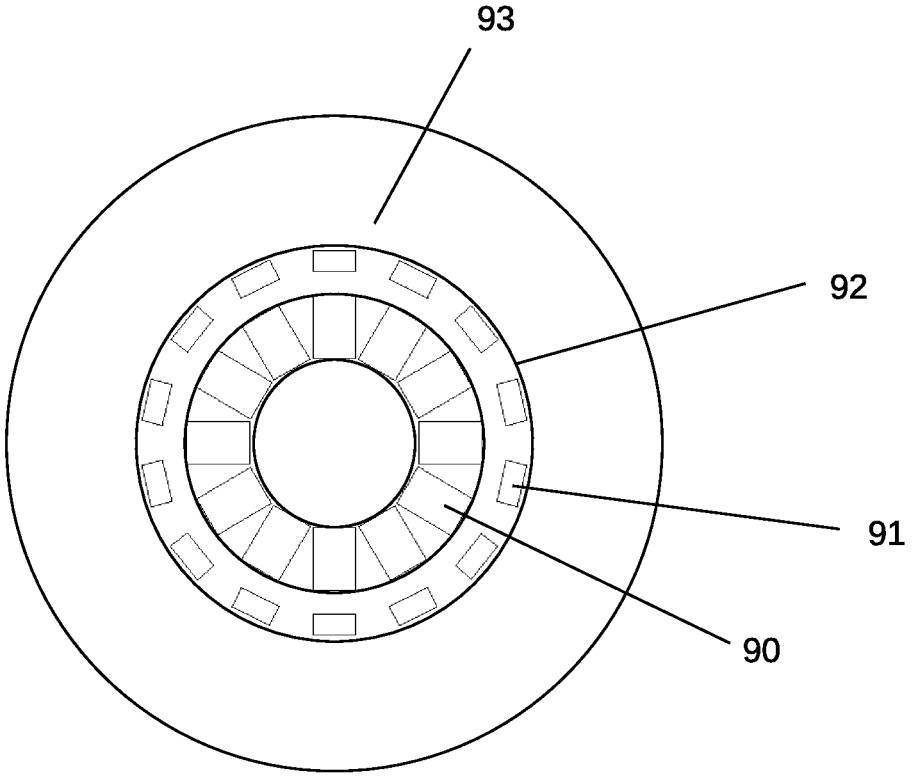
FIG. 8 shows a simplified illustration of a hub motor that can be used with a powered skate with automatic motor control in accordance with one embodiment of the invention.

FIG. 8 shows a simplified illustration of a hub motor that can be used to drive a wheel of a powered skate with automatic motor control in accordance with one embodiment of the invention. In a hub motor, the stator 90 is the stationary part of the motor that contains the windings, which are a plurality of wires wound in a manner well known to the art, an example of which is multiple cores of enamel-coated copper wire wound around laminated iron teeth. The stator is fixed to the chassis by a support member that also prevents any rotational movement of the stator. Bearings are located on either side of the stator and generally form the only point of physical contact between the rotating part and the stator. The wires that form the windings of the stator are also located to form connections to the motor driver electronics, passing through the inside of at least one of the bearings. The rotating part of the hub motor consists of magnets 91 arranged in a circular pattern within a rotor case 92, and is attached to a ground contacting element such as a tire 93. In other embodiments, other suitable hub motors can be used.

FIGS. 9*a*, 9*b* and 9*c* show illustrations of the isometric, side and section views of a hub motor used in accordance with one embodiment of the invention. The rotor includes the rotor can 94 which may be an iron alloy, the magnets 95 which are affixed around the inside of the rotor can, the outer hub 96 and the inner hub 97 which support the rotor on the bearing 98. The wheel, not shown, is to be located around the outside of the rotor can and retained between the two outer hubs. The stator includes the wire windings 99, the stator pin 100 and the support 101. The phase wires 103 are disposed to run from the windings, through a hole into a hollow section of the stator pin, along the stator pin inside the bearings, and then out of the motor.

In certain embodiments, a controller sends signals to the motor driver electronics, which cause current to flow in one or more of the windings to create torque in the direction required. The controller controls how current is applied to the windings by means of a sensor that measures voltages on the windings, or by a sensor that measures the rotational position of the rotor, or both.

In certain embodiments, the skate contains a sensor that measures the rotational position of the rotor which consists of a plurality of magnetic field sensors that are positioned near the motor's rotor in such a manner as to each sense a different portion of the magnetic fields created by the magnets. The magnetic field sensors may be located either inside or outside of the rotor.

In certain embodiments, the stator of the hub motor has a temperature sensor incorporated into it. The control system may alter the amount of current permitted to flow in the windings in response to temperature measurements.

The absence of any gears, belts, electrical brushes or other points of physical contact between the stationary and rotating parts except for the bearing can allow the wheel and motor to rotate during normal skating without absorbing significant amount of energy when it is not generating torque.

It is to be understood that a practical controller, for example one implemented within the software of one or more microcontrollers, will also contain a number of other elements, including but not limited to: communications, timing, data logging, user interface, power management and fault detection.

The digital communication link may be a wired multiple device network such as Controller Area Network (CAN), Inter-Integrated Circuit (I2C), differential serial communications of specification RS485, the digital communication link may be a direct logic level digital connection between the skates, the digital communication link may be a wireless digital connection between the skates such as Zigbee, Bluetooth or PSK modulated FM, or the digital communication link may be any of the other digital communications systems known to the art.

In certain embodiments, parts of the system including the battery or energy storage device are located remotely from the skate and attached to a different part of the body of the rider and transfers energy to and from the skate by means of at least a pair of wires.

In certain embodiments, the system includes a user input device such as a button or trigger that the user may use to provide signals to the controller. The controller may modify its operating state based on the user input.

In certain embodiments, the pair of skates contain at least one sensor to determine the position of the skates relative to each other. This sensor may be any of the distance or direction sensors known to the art including ultrasonic distance sensors, Radio Frequency direction sensors, optical or infrared imaging or detection sensors or magnetic sensors. The controller modifies the distribution of torque between the two skates based on their relative position.

It is to be understood that the embodiments described herein are merely exemplary and numerous modifications and variations will be apparent to those skilled in the art. All such modifications and variations are intended to be within the scope of the present inventions.

What is claimed is:

1. A system for controlling powered skates, the system comprising:

a pair of powered skates, each comprising:

a foot platform configured to receive a foot of a rider;

a plurality of wheels coupled to the foot platform;

a hub motor integral to at least one of the plurality of wheels, the hub motor configured to rotate the at least one wheel; and a load sensor coupled to the foot platform and configured to sense an applied force; and a controller coupled to each of the hub motors and to each of the load sensors, the controller configured to cause each of the hub motors, using a single algorithm, to generate a forward torque based on signals received from each of the load sensors.

2. The system of claim 1, wherein each of the powered skates further comprises a speed sensor coupled to the controller.

3. The system of claim 1, wherein the controller is further configured to:

compare a weight distribution of the rider on each of the powered skates to a threshold; and control each of the hub motors to generate a torque that inhibits the rider from falling when the weight distribution exceeds the threshold.

4. The system of claim 1, wherein the controller is further configured to:

determine a weight distribution across each of the powered skates based on the signals received from each of the load sensors;

determine a total torque to be applied to the powered skates to cause a desired condition;

apply a first percentage of the total torque to one of the powered skates based on the weight distribution; and apply a second percentage of the total torque to the other of the powered skates based on the weight distribution, wherein the first percentage and the second percentage add up to 100 percent.

5. The system of claim 1:

wherein each of the powered skates further comprises a speed sensor coupled to the controller; and wherein the controller is further configured to:

compare a weight distribution of the rider on each of the powered skates based on the signals from the load sensors to a threshold;

compare a signal from the speed sensor of one of the powered skates to a signal from the speed sensor of the other of the powered skates;

detect a forward skating action based on the comparison of the weight distribution and the comparison of the signals from the speed sensors; and control each of the hub motors to assist the forward skating action.

6. The system of claim 1:

wherein each of the powered skates further comprises a speed sensor coupled to the controller; and wherein the controller is further configured to:

measure a speed based on signals from each of the speed sensors; and control, based on a mode of operation and the measured speed, each of the hub motors to oppose motion of the respective powered skates.

7. The system of claim 1, further comprising an angle sensor coupled to a torso of the rider and the controller;

wherein the controller is further configured to:

compare a signal from the angle sensor to a threshold; and control, based on the comparison, the hub motors to oppose a forward motion of the powered skates.

8. The system of claim 1, wherein the controller comprises:

a first controller coupled to one of the pair of powered skates;

a second controller coupled to the other of the pair of powered skates; and a master controller coupled to the first controller and the second controller.

9. A system for controlling powered skates, the system comprising:

a pair of powered skates, each comprising:

a foot platform configured to receive a foot of a rider;

a front wheel coupled to the foot platform;

a rear wheel coupled to the foot platform and positioned closer to an area of the foot platform for receiving a heel of the rider than the front wheel;

a hub motor integral to at least one of the front wheel and the rear wheel, the hub motor configured to rotate the at least one of the front wheel and the rear wheel;

a load sensor coupled to the foot platform and configured to sense an applied force; and a steerable truck coupled to the foot platform, wherein one of the front wheel or the rear wheel comprises a first wheel and a second wheel spaced apart in a direction lateral to a forward motion of the respective powered skate, and the first wheel and the second wheel are coupled to the steerable truck; and a controller coupled to each of the hub motors and to each of the load sensors, the controller configured to control each of the hub motors, using a single algorithm, based on signals received from the load sensors.

10. The system of claim 9:

wherein each of the hub motors is integral to the respective front wheel, wherein the respective front wheel is the only wheel proximate a front area of the respective powered skate;

wherein the respective rear wheel comprises the first wheel and the second wheel; and wherein the steerable truck is positioned between the first wheel and the second wheel.

11. The system of claim 9, wherein each of the powered skates further comprises:

a chassis coupled to the front wheel and to the rear wheel, the chassis coupled between the foot platform and both of the front wheel and the rear wheel; and an attachment configured to attach the chassis to the foot platform, wherein the load sensor is a component of the attachment.

12. The system of claim 11, wherein, for each of the powered skates, the load sensor is positioned under the chassis and a coupling of the load sensor extends through a hole in the chassis.

13. The system of claim 9, wherein each of the powered skates further comprises:

one or more straps configured to attach a shoe of the foot of the rider, wherein at least one of the one or more straps comprises a quick release mechanism.

14. The system of claim 9, wherein the controller is configured to:

control, a first mode of operation, at least one of the hub motors to oppose a motion of the respective powered skate;

control, in a second mode of operation, at least one of the hub motors to not oppose a motion of the respective powered skate; and control, in a third mode of operation, at least one of the hub motors to assist a motion of the respective powered skate.

15. A system for controlling powered skates, the system comprising:

a pair of powered skates, each comprising:

a foot platform configured to receive a foot of a rider;

a plurality of wheels coupled to the foot platform; and a hub motor integral to at least one of the plurality of wheels, the hub motor configured to rotate the at least one wheel;

a motion sensor coupled to a body of the rider and configured to sense motion in a torso of the rider; and a controller coupled to each of the hub motors and to each of the motion sensors, the controller configured to cause at least one of the hub motors, using a single algorithm, to generate a braking torque on the respective powered skate based on a signal received from the motion sensor.

16. The system of claim 15, wherein the motion sensor is configured to measure a characteristic of the rider selected from an angle of the body and an angular rate of change of the body.

17. The system of claim 15:

wherein each of the powered skates further comprises a speed sensor; and wherein the controller is further configured to:

control, in a preselected mode of operation, at least one of the hub motors to oppose, when a change from a preselected set point of a signal from the speed sensor occurs, a motion of the respective powered skate; and modify the preselected set point based on the signal received from the motion sensor.

18. The system of claim 15, wherein the motion sensor is coupled to a waistline area of the rider.

19. A method for controlling powered skates, the method comprising:

providing a pair of powered skates, each comprising:

a foot platform configured to receive a foot of a rider;

a plurality of wheels coupled to the foot platform;

a hub motor integral to at least one of the plurality of wheels, the hub motor configured to rotate the at least one wheel; and a load sensor coupled to the foot platform and configured to sense an applied force; and controlling, using a controller coupled to each of the hub motors and to each of the load sensors, each of the hub motors, using a single algorithm, to generate a forward torque based on signals received from each of the load sensors.

20. The method of claim 19:

wherein each of the powered skates further comprises a speed sensor coupled to the controller; and wherein the controlling, using the controller coupled to each of the hub motors and to each of the load sensors, each of the hub motors comprises:

determining a weight distribution across each of the powered skates based on the signals received from each of the load sensors;

determining a total torque to be applied to the powered skates to cause a desired condition;

applying a first percentage of the total torque to one of the powered skates based on the weight distribution;

applying a second percentage of the total torque to the other of the powered skates based on the weight distribution, wherein the first percentage and the second percentage add up to 100 percent;

comparing a signal from the speed sensor of one of the powered skates to a signal from the speed sensor of the other of the powered skates;

detecting a forward skating action based on the weight distribution and the comparison of the signals from the speed sensors; and controlling each of the hub motors to assist the forward skating action.

21. The method of claim 19, wherein the controlling, using the controller coupled to each of the hub motors and to each of the load sensors, each of the hub motors comprises:

determining a weight distribution across each of the powered skates based on the signals received from each of the load sensors;

determining a total torque to be applied to the powered skates to cause a desired condition;

applying a first percentage of the total torque to one of the powered skates based on the weight distribution;

applying a second percentage of the total torque to the other of the powered skates based on the weight distribution, wherein the first percentage and the second percentage add up to 100 percent;

comparing a signal from an angle sensor, coupled to a body of the rider and the controller, to a preselected threshold; and controlling, based on the comparison, the hub motors to oppose a forward motion of the powered skates.

* * * * *